US006526245B1

(12) United States Patent
Yamashita

(10) Patent No.: US 6,526,245 B1
(45) Date of Patent: Feb. 25, 2003

(54) IMAGE FORMING APPARATUS

(75) Inventor: Toshimi Yamashita, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/649,993

(22) Filed: Aug. 29, 2000

(51) Int. Cl.[7] ..... G03G 15/08
(52) U.S. Cl. ..... 399/254; 399/258; 399/263
(58) Field of Search ..... 399/111, 119, 399/120, 254, 256, 258, 262, 263

(56) References Cited

U.S. PATENT DOCUMENTS 5,576,814 A * 11/1996 Nishimura et al. ..... 399/262
RE37,542 E * 2/2002 Ichikawa et al. ..... 399/263

FOREIGN PATENT DOCUMENTS

JP 7-40156 5/1995
JP 7-43554 5/1995
JP 10-301375 11/1998

* cited by examiner

*Primary Examiner*—Hoang Ngo
(74) *Attorney, Agent, or Firm*—Foley & Lardner

(57) ABSTRACT

An image forming apparatus according to the present invention has a developing roller for supplying a developer to a developing target, a housing for accommodating the developer, and an agitating member having a sheet-like member with a plurality of fin-like portions arranged in an axial direction of the developing roller and which are polygons each having a first free length extending from a rotational axis parallel with a rotational axis of the developing roller in a circumferential direction toward a wall surface of the housing, the fin-like portion having an opening formed in a portion thereof. When the agitating member is rotated to rotate the sheet-like member along an inner wall of the housing, the developer can be efficiently conveyed to the developing roller and dispersed in the axial direction of the developing roller for agitation. Thus, a difference in density is prevented from occurring in an output image.

24 Claims, 4 Drawing Sheets

IMAGE FORMING APPARATUS

BACKGROUND OF THE INVENTION

The present invention relates to a developing device for supplying an electrostatic image with toner that is a visualizing material to develop the electrostatic image, the developing device being used in an image forming apparatus represented, for example, by an electrophotographic copying apparatus or a laser beam printer.

Known developing devices integrated into image forming apparatuses using an electrophotographic process are classified into a two-component system using carrier particles and toner and a one-component system using only toner.

The two-component developing device attaches the toner to carrier particles, carries it to an outer periphery of a developing sleeve to form a developer layer on the outer periphery of the developing sleeve, and brings the developer layer into contact with a surface of a photosensitive drum so that a Coulomb force of an electrostatic latent image previously formed on the photosensitive drum causes the toner to be separated from the carrier particles and then attached to the electrostatic latent image to develop the electrostatic image.

The one-component developing device forms a thin layer including only of the toner, on an outer periphery of the developing sleeve, opposes the photosensitive drum to the developing sleeve at a predetermined interval, and selectively supplies the toner to an electrostatic latent image formed on the photosensitive drum to develop this image.

Pseudo two-component developing devices have also been proposed which are actually one-component developing devices but which use a small amount of magnetic carrier.

Known pseudo two-component developing devices are disclosed in Jpn. Pat. Appln. KOKOKU Publication No. 7-40156 and Jpn. Pat. Appln. KOKOKU Publication No. 7-43554. These publications disclose an example having carrier particles accommodating area located below the developing sleeve to prevent the carrier particles, falling from the developing sleeve, from mixing into a toner holding section.

On the other hand, an example having an area located below the developing sleeve to hold the developer is disclosed in Jpn. Pat. Appln. KOKAI Publication. No. 9-6106. According to this publication, part of a developing housing is formed below the developing sleeve, the developing housing holds the developer supplied by a rotating arm rotated around a rotational center located below a rotational center of the developing sleeve.

The above described developing devices have a developer/toner conveying mechanism for conveying the developer or toner to the developing sleeve in order to form a developer layer or a toner layer on the developing sleeve.

Developer/toner conveying mechanisms are widely used which have a hopper above the developing sleeve so that the developer/toner is supplied to the developing sleeve based on free fall. After setup, even the two-component developing device is typically refilled only with the toner, which has been consumed to form images. The toner hopper will be described below.

Many toner hoppers include a toner holding section for accommodating the toner and an agitator for guiding the toner to the developing sleeve while agitating the toner in the toner holding section, to convey the toner to the developing sleeve based on the previously described free fall and conveyance of the toner carried out by the agitator.

The agitator extends parallel with an axis at the rotational center of the developing sleeve and has at least one fin-like toner agitating member made, for example, of a resin mold and extended in a radial direction orthogonal with the axis, the toner agitating member being slightly shorter than the radius (inner radius) of the toner holding section, and at least one sheet-like toner conveying member extended in a radial direction of the developing sleeve and which is longer than the inner diameter of the toner holding section, wherein the toner agitating member and the toner conveying member being arranged on the same rotating shaft so as to be rotated at a predetermined rotation speed.

However, many image forming apparatuses have been proposed in which the rotational center of the developing sleeve is located below the rotational center of the photosensitive drum. With these image forming apparatuses, it may be difficult to supply the toner to the developing sleeve based on the free fall, due to the arrangement of a system for conveying paper or another system.

Thus, examples have been proposed which include, in addition to the agitator, a toner conveying paddle or roller provided between the developing sleeve and the toner hopper to maintain (increase) the amount of toner supplied to the developing sleeve.

With the toner conveying paddle or roller, however, the developing device with the toner hopper in which the rotational center of the developing sleeve is located below the rotational center of the photosensitive drum may require the toner to be supplied even when a large amount of toner actually remains in the toner holding section in the toner hopper.

Alternatively, in the developing device using the agitator to convey the toner from the toner hopper to the developing sleeve, if a position where the toner is added is limited to a neighborhood of the center of an axis of the agitator (toner hopper) due to an ejection position of an auger conveyor, a large amount of time may be required to disperse the added toner in an axial (longitudinal) direction of the developing sleeve. This may make toner density uneven in the axial direction of the developing sleeve, resulting in an uneven density in a developed image.

Furthermore, when a large amount of supplied toner is present in one location within the toner hopper in the axial direction of the developing sleeve, a drive mechanism for rotating the agitator require a large torque, thereby increasing costs of the developing device.

BRIEF SUMMARY OF THE INVENTION

It is an object of the present invention to provide an image forming apparatus that can prevent an uneven image density resulting from an insufficient toner supply to maintain a stable image density for a long time.

It is another object of the present invention to provide an image forming apparatus that can reduce the amount of toner, which may remain in a toner hopper.

It is yet another object of the present invention to provide an image forming apparatus that can stably supply toner to a developing roller.

The present invention provides a developing device for developing a latent image formed on an image bearing member by supplying the latent image with a developer that is a visualizing agent, the developing device comprising: a housing having a wall surface extended in a first direction parallel with the direction of a rotational axis of the image bearing member and having a cylinder or part thereof having its radius defined in a direction orthogonal with the first direction, the housing holding the developer supplied to the latent image formed on the image bearing member; a developing roller located below the rotational axis of the image bearing member in a vertical direction, having a rotational center parallel with the first direction, and formed so as to rotate around the rotational center; and an agitating member having a rotational center extended in the first direction and rotated within the housing along the wall surface, the agitating member having a sheet-like member with a plurality of fin-like portions arranged therein and which are polygons each having a first free length extending from the rotational center in a circumferential direction toward the wall surface of the housing and a second free length that is longer than the first free length, the fin-like portion having an opening formed in a portion thereof, the agitating member conveying the developer to the developing roller and dispersing the developer in the first direction for agitation when the sheet-like member is rotated along an inner wall of the housing.

The present invention also provides an image forming method comprising steps of: forming a latent image on an image bearing member; and selectively supplying toner to the latent image formed on the image bearing member to develop the latent image, using a developing device having a housing having a wall surface extended in a first direction parallel with the direction of a rotational axis of the image bearing member and having a cylinder or part thereof having its radius defined in a direction orthogonal with the first direction, the housing holding the developer supplied to the latent image formed on the image bearing member, a developing roller located below the rotational axis of the image bearing member in a vertical direction, having a rotational center parallel with the first direction, and formed so as to rotate around the rotational center, and an agitating member having a rotational center extended in the first direction and rotated within the housing along the wall surface, the agitating member having a sheet-like member with a plurality of fin-like portions arranged therein and which are polygons each having a first free length extending from the rotational center in a circumferential direction toward the wall surface of the housing and a second free length that is longer than the first free length, the fin-like portion having an opening formed in a portion thereof, the agitating member conveying the developer to the developing roller and dispersing the developer in the first direction for agitation when the sheet-like member is rotated along an inner wall of the housing.

The present invention further provides an image forming apparatus comprising: a developing device including: a photosensitive body on which a latent image corresponding to image information to be output is formed; a developing magnet having N and S poles alternately arranged inside, the developing magnet being rotated; a sleeve formed so as to rotate around an outer periphery of the developing magnet to supply an image bearing member with toner to be supplied to the latent image formed on the photosensitive body; a toner hopper constituting part of the housing, provided below a rotational center of the sleeve at a predetermined interval in a vertical direction, and having a table section for temporarily holding toner supplied to the sleeve in order to accommodate the toner supplied to the sleeve; and an agitating member having a rotational center extended in the first direction and rotated within the housing along the wall surface, the agitating member having a sheet-like member with a plurality of fin-like portions arranged therein and which are polygons each having a first free length extending from the rotational center in a circumferential direction toward the wall surface of the housing and a second free length that is longer than the first free length, the fin-like portion having an opening formed in a portion thereof, the agitating member conveying the developer to the developing roller and dispersing the developer in the first direction for agitation when the sheet-like member is rotated along an inner wall of the housing, the developing device developing the latent image formed on the photosensitive body by selectively supplying the latent image with the toner, the image forming apparatus further including a transfer device for transferring the toner formed on the photosensitive body by the developing device, to a transfer object.

DETAILED DESCRIPTION OF THE INVENTION

A developing device according to an embodiment of the present invention will be described below in detail with reference to the drawings.

Figure 1:
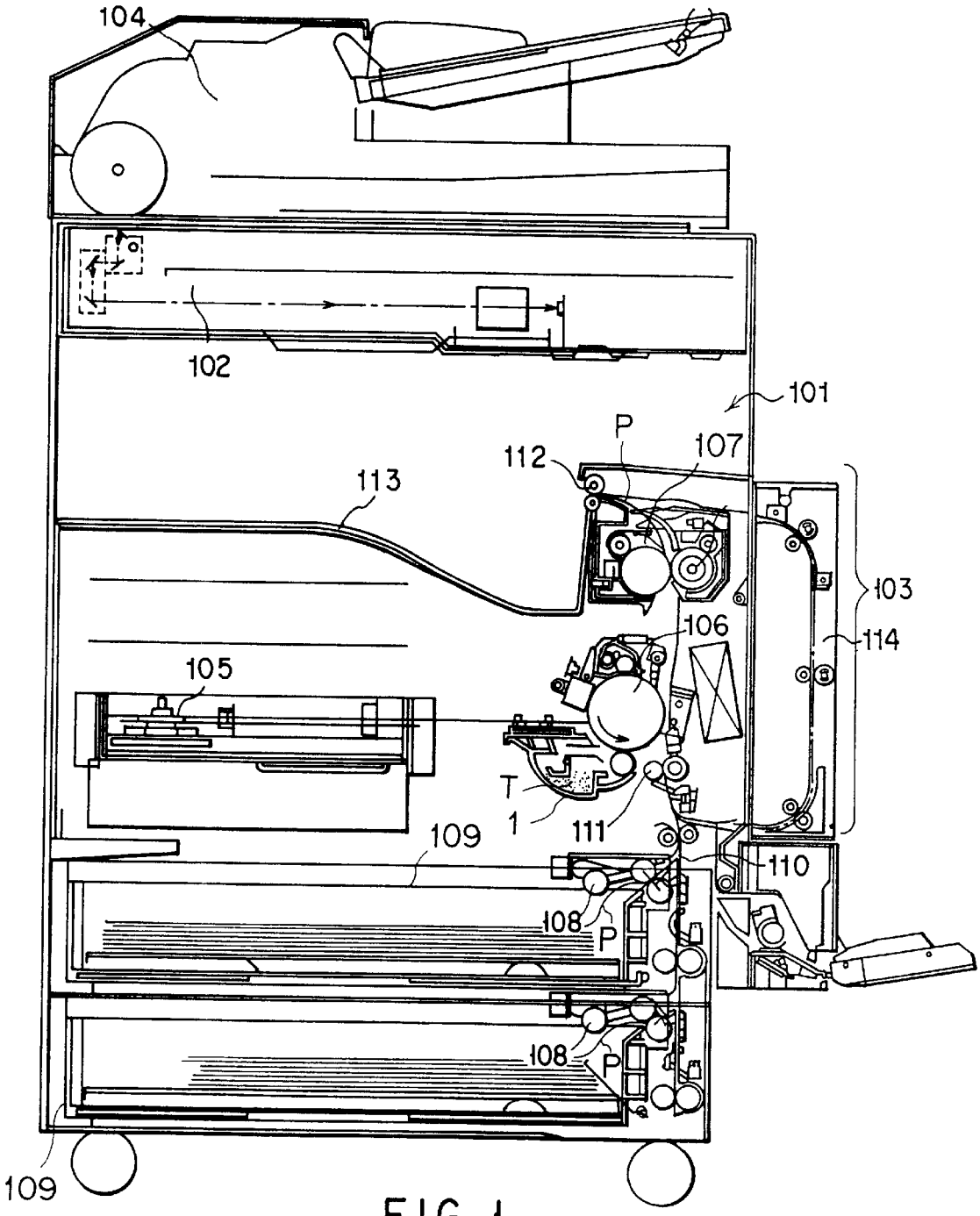
FIG. 1 is a schematic view useful in explaining the entire configuration of an image forming apparatus to which an embodiment of the present invention is applied.

FIG. 1 is a schematic view useful in explaining a digital copying apparatus 101 that is an example of an image forming apparatus.

As shown in FIG. 1, the digital copying apparatus 101 has a scanner 102 for reading image information from a copying object, that is, a book or an arbitrary number of sheet-like documents, as bright and dark portions to generate an image signal, and an image forming section 103 for forming an image corresponding to the image signal supplied by the scanner 102 or an external source. The scanner 102 integrally has an automatic document feeding device (ADF) 104 for sequentially changing, if the copying object is in the form of a sheet, the sheet-like copying object in connection with an image reading operation performed by the scanner.

The image forming section 103 has an exposure device for applying a laser beam corresponding to image information supplied by the scanner 102 or an external device, a photosensitive drum 106 for holding an image corresponding to the laser beam from the exposure device 105, a developing device 1 for developing the image formed on the photosensitive drum 106 by supplying a developer to the image, and a fixing device 107 for heating and melting the developer transferred to a transfer material fed by a paper conveying section, described below, in order to fix the developer to the transfer material, the developer having been on the photosensitive drum 106 due to the development carried out by the developing device 1, as shown in FIG. 1.

When the image information is supplied by the scanner 102 or the external device, the photosensitive drum 106, which has already been charged to a predetermined potential, is irradiated with a laser beam from the exposure device 105 having its intensity modulated based on the image information.

Thus, an electrostatic latent image corresponding to an image to be copied is formed on the photosensitive drum 106.

The electrostatic latent image formed on the photosensitive drum 106 is developed when selectively provided with toner T by the developing device 1. The electrostatic latent image is then transferred to paper P that is a transfer material supplied from a cassette described below, by means of electric fields provided by a transfer device, which is not described in detail.

The toner T transferred to the paper P is conveyed, to the fixing device 107, where it is melted and fixed to the paper P.

The paper P is picked up by a pickup roller 108 from a paper cassette 109 provided below the photosensitive drum 106 in such a manner that one sheet is picked up during each picking-up operation. The paper P is then conveyed along a conveying passage 110 leading to the photosensitive drum 106, to an aligning roller 110 for aligning the paper with a toner image (a developer image) formed on the photosensitive drum 106, and is then fed, using a predetermined timing, to a transfer position where the photosensitive drum 106 and the transfer device are mutually opposed.

The paper P to which the image formed of the toner T has been fixed is then ejected by an ejection roller 112 into an ejection space (a paper ejection tray) 113 defined between the scanner 102 and the cassette 109. A double-side paper feeding device 114 is provided between the fixing device 107 and the cassette 109 to reverse, as required, the paper with an image fixed to one side thereof.

Next, the developing device 1 will be explained.

Figure 2:
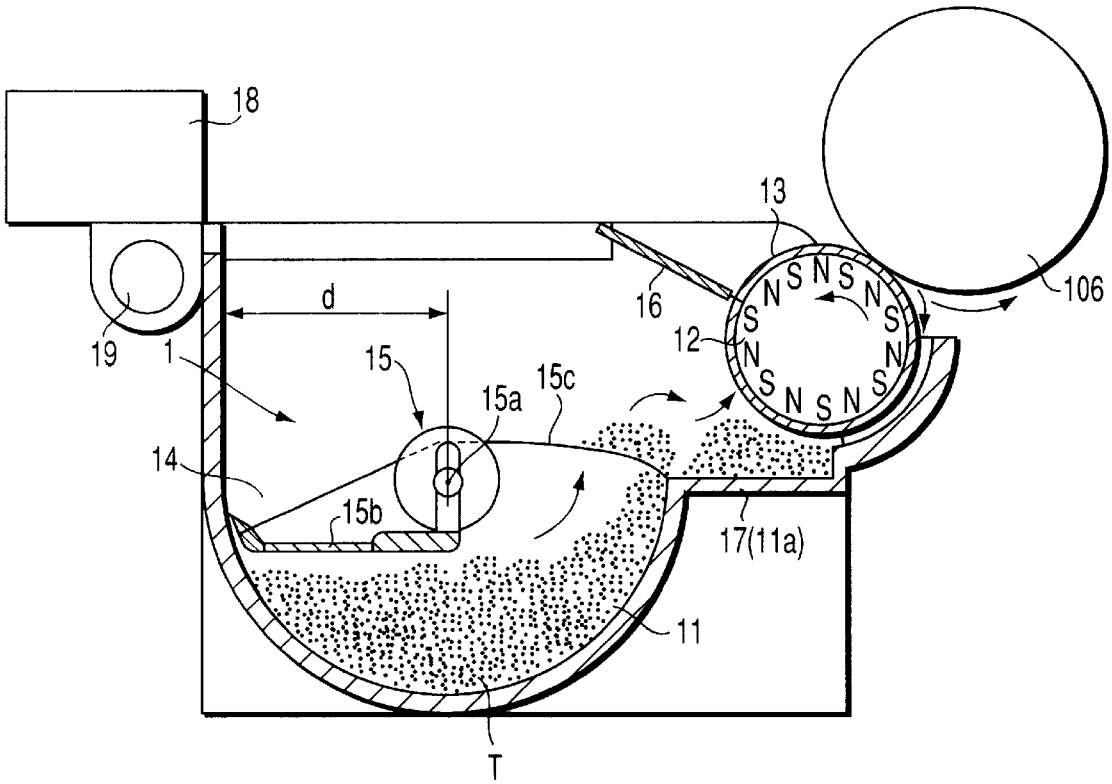
FIG. 2 is a schematic view showing in an enlarged view a developing device integrated into the image forming apparatus shown in FIG. 1.
Figure 3:
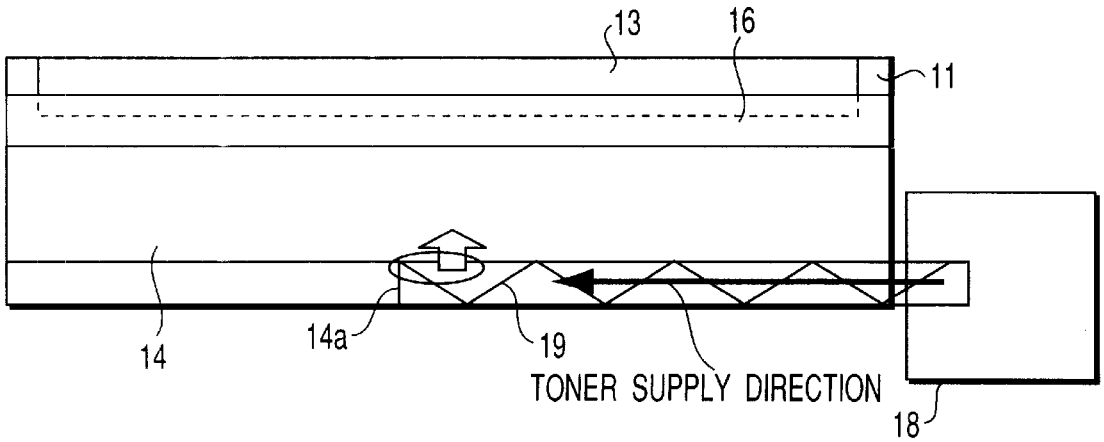
FIG. 3 is a top view of the developing device shown in FIG. 2.

FIG. 2 is a schematic sectional view useful in explaining an embodiment of the fixing device integrated into the digital copying device shown in FIG. 1. FIG. 3 is a schematic view useful in explaining how the developing device shown in FIG. 2 is seen from above.

As is apparent from FIGS. 2 and 3, the developing device 1 has a housing 11.

A start agent containing carrier particles and toner previously mixed together is supplied to the housing when operation is started, while only the toner is supplied during subsequent toner supplies. The toner has, for example, a magnetic toner having an average particle size of 11 $\mu$m and magnetized by mixing a magnetic material into the toner. The carrier particles made from, for example, ferrite- or iron-based carrier having an average particle size of 65 $\mu$m.

The housing integrally has at a predetermined position thereof a rotatable magnet roller 12 and a developing sleeve 13 formed on an outer periphery of the magnetic roller 12 so as to rotate independently of the magnetic roller 12. The developing device 1 is located so that the interval between an outer peripheral surface of the developing sleeve 13 and an outer periphery of the photosensitive drum 106 is about 0.35 mm when they are mutually closest. Additionally, the developing sleeve 13 has a diameter of 20 mm and is rotated at a movement speed of 254 mm/s, at a position where it is opposed to the outer peripheral surface of the photosensitive drum 106, in the same direction as the photosensitive drum 106.

The magnet roller 12 has, for example, 12 poles including N and S poles alternately arranged at generally even intervals in a circumferential a direction as seen from a direction orthogonal with its center axis. Each magnet pole of the magnet roller 12 exerts a magnetic force of about 700 Gauss as measured on a surface of the developing sleeve. In addition, the magnet roller 12 is rotated, for example, at a speed of 2,000 rpm in a direction opposite to the direction in which the developing sleeve 13 is rotated.

Below an axis of the developing sleeve 13 in a vertical direction are provided a toner hopper 14 also constituting part of the housing 11 and accommodating toner, which is consumed to form images, and an agitator 15. rotatably provided in the toner hopper 14 at a predetermined position to agitate the toner in the toner hopper 14 to transfer it to the developing sleeve 13. A rotational center of the agitator is located below a rotational center of the developing sleeve 13 in the vertical direction. In addition, the agitator 15 is rotated in the same direction as the magnet roller 12 in this example.

A blade 16 for adjusting the thickness of a toner layer to a predetermined value, the toner layer being formed when toner supplied by the agitator 15 of the toner hopper 14 adheres to the outer peripheral surface of the developing sleeve 13, is provided at a predetermined position around the developing sleeve 13 and on an upstream side of the direction in which the developing sleeve 13 is rotated relative to the position where the developing sleeve 13 is opposed to the photosensitive drum 106 of the image forming section 103 previously described with reference to FIG. 1. The blade 16 is provided at such a position that the interval between its tip portion and the outer peripheral surface of the developing sleeve 13 is about 0.25 mm when they are mutually closest and that the blade does not affect a circle defined when the agitator 15 is rotated.

A portion of the housing 1 which joins the toner hopper 14 to an area where the developing sleeve 13 is located is used to increase the amount of toner attached to the peripheral surface of the developing sleeve 13, the toner being located under the developing sleeve 13 after being conveyed by the agitator 15. That is, a stage section 11*a* of the housing 11 which is located below the developing sleeve 13 and which connects the toner hopper 14 to a portion of the housing covering the developing sleeve 13 functions as a toner table 17 for temporarily holding the toner conveyed by the rotating agitator 15. The height of the toner table 17 is defined so that the table 17 is located vertically below the center of a rotating shaft 15*a* of the agitator located in the toner hopper 14. Additionally, the horizontal length of the toner table 17 is defined to be equivalent to or smaller than the diameter of the developing sleeve 13.

A toner cartridge holding section 18 is formed at a predetermined position of the toner hopper to hold a toner cartridge for externally supplying toner. An auger conveyor 19 is provided between the toner cartridge holding section 18 and toner supplying position 14*a* of the toner hopper 14 to convey, to an interior of the toner hopper 14, the toner accommodated in the toner cartridge attached to the toner cartridge holding section 18. As seen in FIG. 3, the toner supplying position 14*a* is defined generally at the center of the toner hopper 14 in a longitudinal direction thereof, that is, a direction parallel with the rotating directions of the developing sleeve 13 and photosensitive drum 106.

Figure 4:
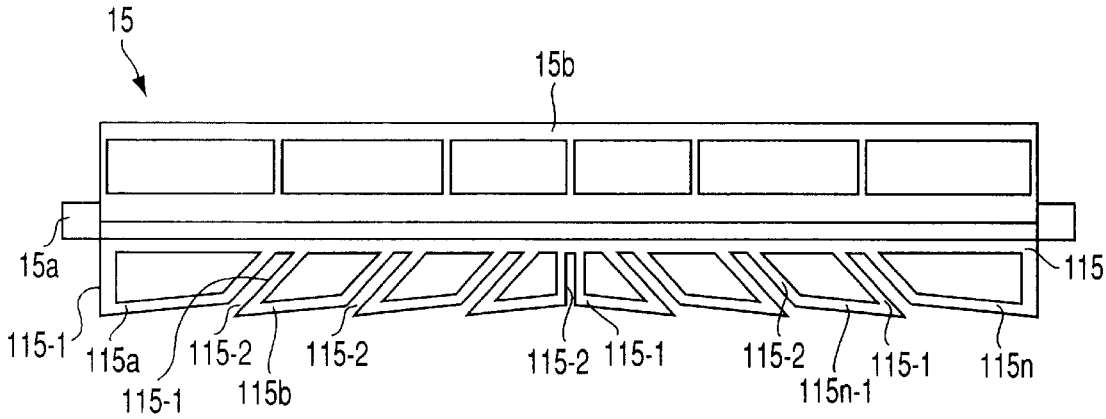
FIG. 4 is a schematic view useful in explaining a configuration of an agitating mechanism integrated into a toner storage section of the developing device shown in FIGS. 2 and 3.

FIG. 4 is a schematic view useful in explaining a film part of the agitator integrated into the developing device shown in FIGS. 2 and 3.

As shown in FIG. 4, the agitator 15 includes a mold section 15*b* molded integrally with the rotating shaft 15*a* and a film part 115 provided separately from the rotating shaft 15*a*. The mold section 15*a* and the film part 115 each have a plurality of openings formed therein so as to withstand a pressure from the toner in the toner hopper 14 while conveying a predetermined amount of toner.

The mold section 15*b* is molded simultaneously with the rotating shaft 15*a* made of a resin. Even if the toner in the toner hopper is flocculating, when the rotating shaft 15*a* is rotated, the mold section 15*b* can disintegrate the cohering toner while conveying it to the developing sleeve 13 and to the toner table 17 in front thereof.

On the other hand, the film part 115 is, for example, a thin polyester film and can disintegrate the toner while conveying to the developing sleeve 13, a portion of the toner which is located near an inner wall of the hopper 14 and which cannot be conveyed by the mold section 15*b* .

The film part 115 has a plurality of fin-like portions 115*a* to 115*n* each formed to be a rectangle including two sides each having a first or second length (free length) 115-1 or 115-2, that is, the two sides being mutually different in the distance from the rotating shaft 15*a*. The sides of the first and second free lengths of each fin-like portion 115*a* to 115*n* are arranged in predetermined directions. For the fin-like portions 115*a* to 115*n*, the first and second free lengths corresponding to the distances from the rotating shaft 15*a* are such that the first free length 115-1 is defined to be larger than the inner diameter d of the toner hopper 14 by 0.5 to 3 mm whereas the second free length 115-2 is defined to be larger than about 70% of the first free length [100 to 70%]. In addition, the directions of the first and second free lengths 115-1 and 115-2 of each fin-like portion 115*a* to 115*n* are defined such that the second free length 115-2 is directed toward a center in a longitudinal direction of the rotating shaft 15*a* which corresponds to the toner supplying position 14*a* of the toner hopper 14. Accordingly, the fin-like portions 115*a* to 115*n* of the film part 115 are arranged in the order of the first free length 115-1, the second free length 115-2, the first free length 115-1, . . . , the first free length 115-1, the second free length 115-2, and the first free length 115-1 and thus appear to be outward (this means an outward conveying direction) screws as seen from one end of the rotating shaft 15*a* of the agitator 15 in the longitudinal direction thereof.

When the rotating shaft 15*a* with the plurality of rectangular fin-like portions 115*a* to 115*n* is rotated, those portions of the fin-like portions 115*a* to 115*n* which have the first free length 115-1 are rotated in contact with the inner wall of the hopper 14. During this rotation, the rotation of the individual fin-like portions 115*a* to 115*n* is delayed compared to the rotation of the rotating shaft 15*a*. Consequently, the toner in contact with the film part 115 and the fin-like portions 115*a* to 115*n* is conveyed to opposite ends of the rotating shaft 15*a* in the longitudinal direction thereof relative to the toner supplying position 14*a*. This configuration enables the toner supplied from the toner supplying position 14*a* to be sequentially conveyed to the entire area of the toner hopper 14 in the longitudinal direction thereof. As a result, the toner density in the toner hopper 14 becomes even in a short time.

In addition, the film part 115 is projected into the hopper 14 from a position offset from the center of the rotating shaft 15*a* by a predetermined distance. Thus, the toner can be reliably conveyed to the above described toner table. The amount that the film part 115 is offset from the rotating shaft 15*a* is defined such that the film part 115 is located above the toner table in the vertical direction and at a height almost equal to or smaller than that of the lowest portion of the outer peripheral surface of the developing sleeve 13, at least while an open end of the film part 115 is extending in a horizontal direction.

In this manner, the area where the developing sleeve 13 of the housing 11 of the developing device 1 is accommodated is connected to the toner hopper 14 constituting part of the housing, using the toner table 17, the rotational center of the agitator 15 provided in the toner hopper 14 is located above the toner table 17 in the vertical direction, and the length of the film part 115 of the agitator 15 up to its open end is larger than the radius of the toner hopper 14 by about 3 mm at maximum. Accordingly, almost all the toner in the toner hopper 14 can be supplied to the developing sleeve 13 and even if the toner is cohering, it can be disintegrated and uniformly supplied to the developing sleeve 13. In addition, since the plurality of fin-like portions 115*a* to 115*n* are shaped like outward screws by means of the first free length 115-1 and the second free length 115-2, the amount of toner remaining in the toner hopper 14 can be reduced. It has been ascertained that if the toner table 17 is located below the film part 115 of the agitator 15 in the vertical direction when the film part 115 is located so as to extend in the horizontal direction, a larger amount of toner is conveyed to the toner table 17 than if the film part 115 of the agitator is generally level with the toner table 17 or the toner table 17 is located above the film part 115 of the agitator 15 in the vertical direction when the film part 115 is located so as to extend in the horizontal direction.

Figure 5:
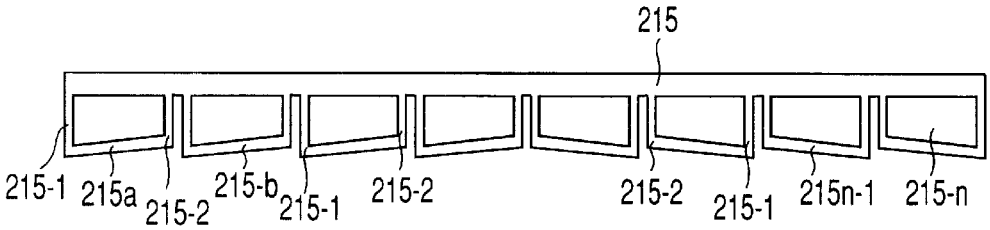
FIG. 5 is a schematic view useful in explaining another configuration of the agitating mechanism integrated into the toner storage section of the developing device shown in FIGS. 2 and 3.

FIG. 5 is a schematic view useful in explaining another embodiment of the shape of the film part of the agitator shown in FIG. 4. Those portions of the configuration which have been described with reference to FIG. 4 are denoted by the same reference numerals and detailed description thereof is omitted.

The agitator 15 shown in FIG. 5 has the mold section 15*b* molded integrally with the rotating shaft 15*a* and a film part 215 provided separately from the rotating shaft 15*a*. The mold section 15*a* and the film part 215 each have a plurality of openings formed therein so as to withstand a pressure from the toner in the toner hopper 14 while conveying a predetermined amount of toner.

The film part 215 is, for example, a thin polyester film and has a plurality of fin-like portions 215*a* to 215*n* each formed to be a trapezoid including two sides each having a first or second length (free length) 215-1 or 215-2, that is, the two sides being mutually different in the distance from the rotating shaft 15*a*. The sides of the first and second free lengths of each fin-like portion 215*a* to 215*n* are arranged in predetermined directions. For the fin-like portions 215*a* to 215*n*, the first and second free lengths corresponding to the distances from the rotating shaft 15*a* are such that the first free length 215-1 is defined to be larger than the inner diameter d of the toner hopper 14 by 0.5 to 3 mm whereas the second free length 215-2 is defined to be larger than about 70% of the first free length, that is, to be 70 to 100% thereof. In addition, the directions of the first and second free lengths 215-1 and 215-2 of each fin-like portion 215*a* to 215*n* are defined such that the second free length 215-2 is directed toward the center in the longitudinal direction of the rotating shaft 15*a* which corresponds to the toner supplying position 14*a* of the toner hopper 14.

When the rotating shaft 15*a* with the plurality of rectangular fin-like portions 215*a* to 215*n* is rotated, those portions of the fin-like portions 215*a* to 215*n* which have the first free length 215-1 are rotated in contact with the inner wall of the hopper 14. During this rotation, the rotation of the individual fin-like portions 215*a* to 215*n* is delayed compared to the rotation of the rotating shaft 15*a*. Consequently, the toner in contact with the film part 215 and the fin-like portions 215*a* to 215*n* is conveyed to the opposite ends of the rotating shaft 15*a* in the longitudinal direction thereof relative to the toner supplying position 14*a* .

Figure 6:
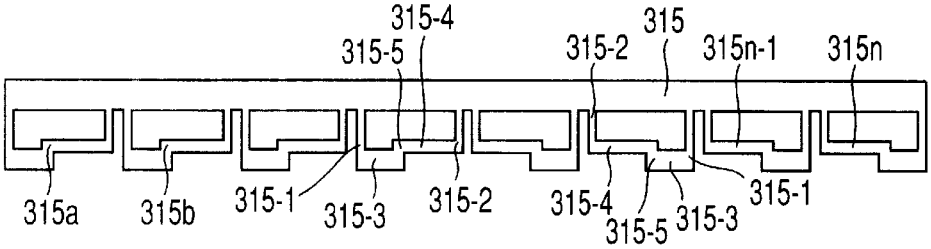
FIG. 6 is a schematic view useful in explaining yet another configuration of the agitating mechanism integrated into the toner storage section of the developing device shown in FIGS. 2 and 3.

FIG. 6 is a schematic view useful in explaining yet another embodiment of the shape of the film part of the agitator shown in FIG. 4. Those portions of the configuration which have been described with reference to FIG. 4 are denoted by the same reference numerals and detailed description thereof is omitted.

The agitator 15 shown in FIG. 6 includes the mold section 15*b* molded integrally with the rotating shaft 15*a* and a film part 315 provided separately from the rotating shaft 15*a*. The mold section 15*a* and the film part 315 each have a plurality of openings formed therein so as to withstand a pressure from the toner in the toner hopper 14 while conveying a predetermined amount of toner.

The film part 315 is, for example, a thin polyester film and has a plurality of fin-like portions 315*a* to 315*n* each formed to be a polygon defined by two sides each having a first or second length (free length) 315-1 or 315-2, that is, the two sides being mutually different in the distance from the rotating shaft 15*a*, a first parallel portion 315-3 extending to a predetermined position in the longitudinal direction of the rotating shaft 15*a* in a fashion maintaining the first free length 315-1, a second parallel portion 315-4 extending to a predetermined position in the longitudinal direction of the rotating shaft 15*a* in a fashion maintaining the second free length 315-2, and a straight line 315-5 joining the first and second parallel portions 315-3 and 315-4 together. The sides of the first and second free lengths of each fin-like portion 315*a* to 315*n* are arranged in predetermined directions. For the fin-like portions 315*a* to 315*n*, the first and second free lengths corresponding to the distances from the rotating shaft 15*a* are such that the first free length 315-1 is defined to be larger than the inner diameter d of the toner hopper 14 by 0.5 to 3 mm whereas the second free length 315-2 is defined to be smaller than about 70% of the first free length [100 to 70%]. In addition, the directions of the first and second free lengths 315-1 and 315-2 of each fin-like portion 315*a* to 315*n* are defined such that the second free length 315-2 is directed toward the center in the longitudinal direction of the rotating shaft 15*a* which corresponds to the toner supplying position 14*a* of the toner hopper 14.

Figure 7:
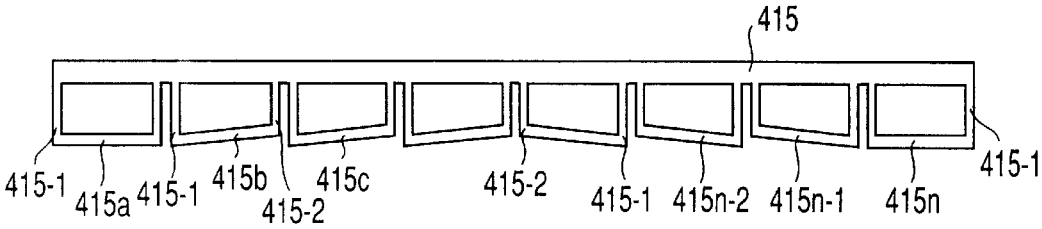
FIG. 7 is a schematic view useful in explaining still another configuration of an agitating mechanism integrated into a toner storage section of the developing device shown in FIGS. 2 and 3.

FIG. 7 is a schematic view useful in explaining still another embodiment of the shape of the film part of the agitator shown in FIG. 4. Those portions of the configuration which have been described with reference to FIG. 4 are denoted by the same reference numerals and detailed description thereof is omitted.

The agitator 15 shown in FIG. 7 has the mold section 15*b* molded integrally with the rotating shaft 15*a* and a film part 415 provided separately from the rotating shaft 15*a*. The mold section 15*a* and the film part 415 each have a plurality of openings formed therein so as to withstand a pressure from the toner in the toner hopper 14 while conveying a predetermined amount of toner.

The film part 415 is, for example, a thin polyester film and has a plurality of fin-like portions 415*b* to 415*n*-1 each formed to be a trapezoid including two sides each having a first or second length (free length) 415-1 or 415-2, that is, the two sides being mutually different in the distance from the rotating shaft 15*a*, and two fin-like portions 415-*a* and 415-*n* located at opposite ends of the rotating shaft 15*a* in the longitudinal direction thereof and each imparted with the area of a rectangular in a fashion maintaining the first free length 415-1. The sides of the first and second free lengths of each fin-like portion 415*b* to 415*n*-1 are arranged in predetermined directions. The directions of the first and second free lengths 415-1 and 415-2 of each fin-like portion 415*b* to 415*n*-1 are defined such that the second free length 415-2 is directed toward the center in the longitudinal direction of the rotating shaft 15*a* which corresponds to the toner supplying position 14*a* of the toner hopper 14.

According to this configuration, even when the rotating shaft 15*a* is rotated, the rotation of the two 415*a* and 415*n* of the fin-like portions 415*a* to 415*n* which are located at the opposite ends of the agitator is not delayed. Accordingly, these fin-like portions 415*a* and 415*n* exert a weaker force in conveying the toner in the longitudinal direction of the rotating shaft 15*a* than the other fin-like portions 415*b* to 415*n*-1. Consequently, the toner in contact with the film part 415 and the fin-like portions 415*b* to 415*n*-1 is conveyed to the opposite ends of the rotating shaft 15*a* in the longitudinal direction thereof relative to the toner supplying position 14*a*. On the other hand, the toner is prevented from undesirable concentration at ends of the toner hopper resulting from the failure of the toner to be conveyed to the opposite ends of the rotating shaft 15*a*. The axial length (the developable width of the developing device 1) of each of the rotating shaft 15*a* of the agitator 15, the developing sleeve 13, and the housing 11 is typically formed to be larger than the length of a shorter side of A3-sized paper.

Figure 8:
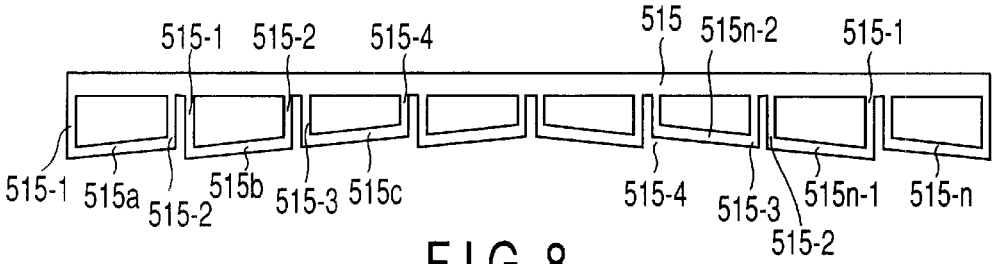
FIG. 8 is a schematic view useful in explaining yet another configuration of the agitating mechanism integrated into the toner storage section of the developing device shown in FIGS. 2 and 3.

FIG. 8 is a schematic view useful in explaining yet another embodiment of the shape of the film part of the agitator shown in FIG. 4. Those portions of the configuration which have been described with reference to FIG. 4 are denoted by the same reference numerals and detailed description thereof is omitted.

The agitator 15 shown in FIG. 8 includes the mold section 15*b* molded integrally with the rotating shaft 15*a* and a film part 515 provided separately from the rotating shaft 15*a*. The mold section 15*a* and the film part 515 each have a plurality of openings formed therein so as to withstand a pressure from the toner in the toner hopper 14 while conveying a predetermined amount of toner.

The film part 515 is, for example, a thin polyester film and has a plurality of fin-like portions 515*a* to 515*n* formed to be plural types of trapezoids including two sides each having a first or second length (free length) 515-1 or 515-2, that is, the two sides being mutually different in the distance from the rotating shaft 15*a*, or a third free length 515-3 smaller than the first free length 515-1 and similar to the second free length and a fourth free length 515-4 smaller than the third free length 515-3. The sides of the first and second free lengths as well as the third and fourth free lengths of the fin-like portions 515*a* to 515*n* are arranged in predetermined directions. The number of fin-like portions formed to be the trapezoids imparted with the two sides of the first and second free lengths is one or two from each end of the rotating shaft 15*a* in the longitudinal direction thereof.

For the fin-like portions 515*a* to 515*n*, the first and second free lengths corresponding to the distances from the rotating shaft 15*a* are such that the first free length 515-1 is defined to be larger than the inner diameter d of the toner hopper 14 by 0.5 to 3 mm whereas the second free length 515-2 is defined to be smaller than about 70% of the first free length [100 to 70%]. Thus, the third free length 515-3 is generally as long as the second free length, and the fourth free length is about 70% of the second and third free lengths 515-2 and 515-3.

The directions of the first and second free lengths 515-1 and 515-2 of each fin-like portion 515*a* to 515*n* are defined such that the second free length 515-2 is directed toward the center in the longitudinal direction of the rotating shaft 15*a* which corresponds to the toner supplying position 14*a* of the toner hopper 14. Likewise, the directions of the third and fourth free lengths 515-3 and 515-4 of each fin-like portion 515*a* to 515*n* are such that the fourth free length 515-4 is directed toward the center in the longitudinal direction of the rotating shaft 15*a* which corresponds to the toner supplying position 14*a* of the toner hopper 14.

According to this configuration, those 515*c* (or 515*b*) to 515*n*-2 (515*n*-1) of the plurality of fin-like portions 515*a* to 515*n* which are closer to the center of the film part are rotated in slight contact with the inner wall of the toner hopper 14 or without contact therewith even when the rotating shaft 15*a* is rotated. Consequently, the fin-like portion 515*c* (or 515*b*) closer to the center conveys smaller amount of toner to the developing sleeve 13 than those at the ends, advantageously avoiding uneven density.

Figure 9:
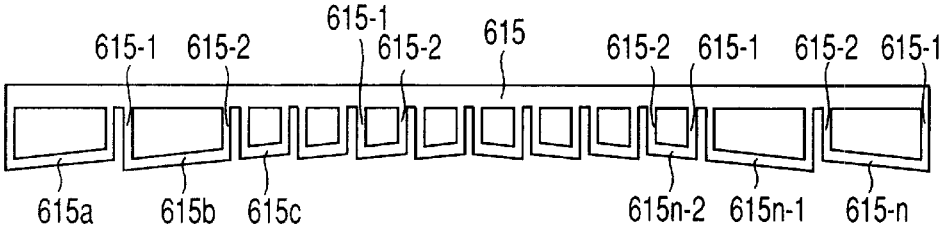
FIG. 9 is a schematic view useful in explaining still another configuration of the agitating mechanism integrated into the toner storage section of the developing device shown in FIGS. 2 and 3.

FIG. 9 is a schematic view useful in explaining still another embodiment of the shape of the film part of the agitator shown in FIG. 4. Those portions of the configuration which have been described with reference to FIG. 4 are denoted by the same reference numerals and detailed description thereof is omitted.

The agitator 15 shown in FIG. 9 has the mold section 15*b* molded integrally with the rotating shaft 15*a* and a film part 615 provided separately from the rotating shaft 15*a*. The mold section 15*a* and the film part 615 each have a plurality of openings formed therein so as to withstand a pressure from the toner in the toner hopper 14 while conveying a predetermined amount of toner.

The film part 615 is, for example, a thin polyester film and has a plurality of fin-like portions 615*a* to 615*n* formed to be plural types of trapezoids including two sides having a first and second lengths (free lengths) 615-1 and 615-2, respectively, that is, the two sides being mutually different in the distance from the rotating shaft 15*a*, and the sides of the first and second free lengths of each fin-like portion 615*a* to 615*n* are arranged in predetermined directions. The plural trapezoidal fin-like portions imparted with the two sides each having the first or second free length is defined to be short in the axial direction of the rotating shaft 15*a* except for the one or two fin-like portions from each end of the rotating shaft 15*a* in the longitudinal direction thereof. In addition, the axial length of the plural trapezoidal fin-like portions having the small axial length is, for example, almost one half of that of the fin-like portions located at the opposite ends in the longitudinal direction. The directions of the first and second free lengths 615-1 and 615-2 of each fin-like portion 615*a* to 615*n* are defined such that the second free length 615-2 is directed toward the center in the longitudinal direction of the rotating shaft 15*a* which corresponds to the toner supplying position 14*a* of the toner hopper 14.

According to this configuration, when the rotating shaft 15*a* is rotated, those 615*c* (or 615*b*) to 615*n*-2 (615*n*-1) of the plural fin-like portions 615*a* to 615*n* which are closer to the center can efficiently disintegrate the cohering toner while conveying the toner to the developing sleeve 13 and the toner table 17 in front thereof.

Figure 10:
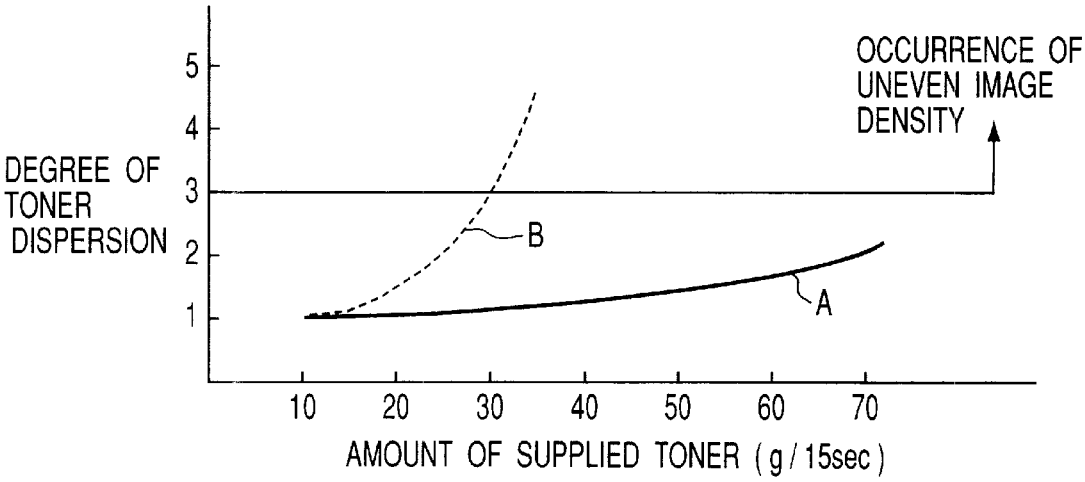
FIG. 10 is a graph showing the level of dispersion of toner in an axial direction which is obtained by using an agitating mechanism shown in FIGS. 4 to 9, in the developing device shown in FIGS. 2 and 3.

FIG. 10 is a graph useful in explaining the level of dispersion of toner conveyed through the toner hopper 14 when the toner is supplied from the toner cartridge at a speed of 1[g] per 15 sec. using a developing device integrated with an agitator having the film part shown in FIG. 4 and a developing device using the fin-like portions of the film part shown in FIG. 2 with the arrangement for the second free length removed therefrom (these fin-like portions are not shown; the radial length thereof composed only of the first free length is uniform). A curve A shows a result obtained with the developing device integrated with the agitator having the film part shown in FIG. 4, whereas a curve (broken line) B shows a result obtained with the developing device in which the fin-like portions have the uniform length.

The curves A and B clearly show that the dispersion (conveyance) of the toner in the axial direction of the developing device is improved by using the developing device integrated with the agitator having the film part shown in FIG. 4.

As described above, the developing device according to the present invention can efficiently convey (disperse) toner in the longitudinal direction of the developing roller, the toner being supplied to the housing of the developing device. This prevents a difference in density occurring in an output image.

In addition, the toner density is prevented from changing within a developing range required for common paper sizes.

Therefore, an image forming apparatus is obtained which can provide a stable image density over a long time.

What is claimed is:

1. A developing device for developing a latent image formed on an image bearing member by supplying the latent image with a developer that is a visualizing agent, the developing device comprising:

a housing having a wall surface extended in a first direction parallel with the direction of a rotational axis of the image bearing member and having a cylinder or part thereof having its radius defined in a direction orthogonal with the first direction, the housing holding the developer supplied to the latent image formed on the image bearing member;

a developing roller located below the rotational axis of the image bearing member in a vertical direction, having a rotational center parallel with said first direction, and formed so as to rotate around the rotational center; and an agitating member having a rotational center extended in said first direction and rotated within said housing along said wall surface, said agitating member having a sheet-like member with a plurality of fin-like portions arranged therein and which are polygons each having a first free length extending from said rotational center in a circumferential direction toward the wall surface of said housing and a second free length that is longer than said first free length, each of the fin-like portions having an opening formed in a section thereof, the agitating member conveying said developer to said developing roller and dispersing the developer in said first direction for agitation when said sheet-like member is rotated along an inner wall of said housing, wherein in each of the fin-like portions of said sheet-like member, the side of said first free length is arranged outward with respect to said first direction.

2. A developing device according to claim 1, wherein:

said rotational center of said agitating member is located below said rotational center of said developing roller in a vertical direction.

3. A developing device according to claim 1, wherein:

said first free length of the plurality of fin-like portions of said sheet-like member is slightly larger than an inner diameter of the housing corresponding to a distance between the rotational center and the wall surface of said housing.

4. A developing device according to claim 1, wherein:

in each of the fin-like portions of said sheet-like member, the side of said second free length is arranged inward with respect to said first direction.

5. A developing device according to claim 1, wherein:

the plurality of fin-like portions of said sheet-like member have different areas and the fin-like portions with the smallest area are located close to a center in said first direction.

6. A developing device according to claim 5, wherein:

the plurality of fin-like portions of said sheet-like member have different areas and arbitrary shapes to the extent that said second free length is not longer than said first free length.

7. A developing device according to claim 5, wherein:

the plurality of fin-like portions of said sheet-like member have different pitches.

8. A developing device according to claim 6, wherein:

the plurality of fin-like portions of said sheet-like member have different pitches.

9. A developing device according to claim 1, wherein:

in one of the plurality of fin-like portions of said sheet-like member which is located at an outmost position in said first direction, said first free length is almost equal to said second free length.

10. A developing device according to claim 1, wherein:

said sheet-like member of said agitating member is fixed, in a horizontal state, to said agitating member above a line segment in the vertical direction, the line segment joining said rotational center of said developing roller and said rotational center of said agitating member.

11. An image forming method comprising steps of:

forming a latent image on an image bearing member; and selectively supplying toner to the latent image formed on said image bearing member to develop the latent image, using a developing device having a housing having a wall surface extended in a first direction parallel with the direction of a rotational axis of the image bearing member and having a cylinder or part thereof having its radius defined in a direction orthogonal with the first direction, the housing holding the developer supplied to the latent image formed on the image bearing member, a developing roller located below the rotational axis of the image bearing member in a vertical direction, having a rotational center parallel with said first direction, and formed so as to rotate around the rotational center, and an agitating member having a rotational center extended in said first direction and rotated within said housing along said wall surface, said agitating member having a sheet-like member with a plurality of fin-like portions arranged therein and which are polygons each having a first free length extending from said rotational center in a circumferential direction toward the wall surface of said housing and a second free length that is longer than said first free length, each of the fin-like portions having an opening formed in a section thereof, the agitating member conveying said developer to said developing roller and dispersing the developer in said first direction for agitation when said sheet-like member is rotated along an inner wall of said housing, wherein in each of the fin-like portions of said sheet-like member, the side of said first free length is arranged outward with respect to said first direction.

12. An image forming method according to claim 11, wherein:

said rotational center of said agitating member of said developing device is located below said rotational center of said developing roller in a vertical direction.

13. An image forming method according to claim 11, wherein:

said first free length of the plurality of fin-like portions of said sheet-like member of said developing device is slightly larger than an inner diameter of the housing corresponding to a distance between the rotational center and the wall surface of said housing.

14. An image forming method according to claim 11, wherein:

said sheet-like member of said agitating member of said developing device is fixed, in a horizontal state, to said agitating member above a line segment in the vertical direction, the line segment joining said rotational center of said developing roller and said rotational center of said agitating member.

15. An image forming apparatus comprising:

a developing device including:

a photosensitive body on which a latent image corresponding to image information to be output is formed;

a developing magnet having N and S poles alternately arranged inside, the developing magnet being rotated;

a sleeve formed so as to rotate around an outer periphery of the developing magnet to supply an image bearing member with toner to be supplied to the latent image formed on the photosensitive body;

a toner hopper constituting part of said housing, provided below a rotational center of said sleeve at a predetermined interval in a vertical direction, and having a table section for temporarily holding toner supplied to said sleeve in order to accommodate the toner supplied to the sleeve; and an agitating member having a rotational center extended in a first direction and rotated within said housing along said wall surface, said agitating member having a sheet-like member with a plurality of fin-like portions arranged therein and which are polygons each having a first free length extending from said rotational center in a circumferential direction toward the wall surface of said housing and a second free length that is longer than said first free length, each of the fin-like portions having an opening formed in a section thereof, the agitating member conveying said developer to said developing roller and dispersing the developer in said first direction for agitation when said sheet-like member is rotated along an inner wall of said housing, the developing device developing said latent image formed on said photosensitive body by selectively supplying said latent image with said toner, the image forming apparatus further including a transfer device for transferring the toner formed on said photosensitive body by said developing device, to a transfer object, wherein in each of the fin-like portions of said sheet-like member, the side of said first free length is arranged outward with respect to said first direction.

16. An image forming apparatus according to claim 15, wherein:

said rotational center of said agitating member of said developing device is located below said rotational center of said developing roller in a vertical direction.

17. An image forming apparatus according to claim 15, wherein:

said first free length of the plurality of fin-like portions of said sheet-like member of said developing device is slightly larger than an inner diameter of the housing corresponding to a distance between the rotational center and the wall surface of said housing.

18. An image forming apparatus according to claim 15, wherein:

said sheet-like member of said agitating member of said developing device is fixed, in a horizontal state, to said agitating member above a line segment in the vertical direction, the line segment joining said rotational center of said developing roller and said rotational center of said agitating member.

19. A developing device for developing a latent image formed on an image bearing member by supplying the latent image with a developer that is a visualizing agent, the developing device comprising:

a housing having a wall surface extended in a first direction parallel with the direction of a rotational axis of the image bearing member and having a cylinder or part thereof having its radius defined in a direction orthogonal with the first direction, the housing holding the developer supplied to the latent image formed on the image bearing member;

a developing roller located below the rotational axis of the image bearing member in a vertical direction, having a rotational center parallel with said first direction, and formed so as to rotate around the rotational center;

an agitating member having a rotational center extended in said first direction and rotated within said housing along said wall surface, said agitating member having a sheet-like member with a plurality of fin-like portions arranged therein and which are polygons each having a first free length extending from said rotational center in a circumferential direction toward the wall surface of said housing and a second free length that is longer than said first free length, each of the fin-like portions having an opening formed in a section thereof, the agitating member conveying said developer to said developing roller and dispersing the developer in said first direction for agitation when said sheet-like member is rotated along an inner wall of said housing, wherein the second free length of said sheet-like member of the agitating member extends toward a toner supplying position.

20. A developing device according to claim 19, wherein:

the second free length of said sheet-like member sends toner supplied at the toner supplying position away from the toner supplying position.

21. A developing device according to claim 20, wherein:

the plurality of fin-like portions of said sheet-like member have different areas and the fin-like portions with the smallest area are located close to a center in said first direction.

22. A developing device according to claim 21, wherein:

the plurality of fin-like portions of said sheet-like member have different areas and arbitrary shapes to the extent that said second free length is not longer than said first free length.

23. A developing device according to claim 21, wherein:

the plurality of fin-like portions of said sheet-like member have different pitches.

24. A developing device according to claim 22, wherein:

the plurality of fin-like portions of said sheet-like member have different pitches.

* * * * *